US010827280B2

(12) United States Patent
Linjama et al.

(10) Patent No.: US 10,827,280 B2
(45) Date of Patent: Nov. 3, 2020

(54) APPARATUS FOR PRODUCING SOUND AND VIBRATION

(71) Applicant: Flexound Systems Oy, Espoo (FI)

(72) Inventors: Jukka Linjama, Espoo (FI); Tommi Immonen, Vantaa (FI)

(73) Assignee: Flexound Systems Oy, Espoo (FI)

( * ) Notice: Subject to any disclaimer, the term of this patent is extended or adjusted under 35 U.S.C. 154(b) by 0 days.

(21) Appl. No.: 16/603,600

(22) PCT Filed: Apr. 11, 2018

(86) PCT No.: PCT/FI2018/050261

§ 371 (c)(1),
(2) Date: Oct. 8, 2019

(87) PCT Pub. No.: WO2018/189422

PCT Pub. Date: Oct. 18, 2018

(65) Prior Publication Data

US 2020/0045474 A1 Feb. 6, 2020

(30) Foreign Application Priority Data

Apr. 13, 2017 (FI) ..... 20174102 U

(51) Int. Cl.
*H04R 9/06* (2006.01)
*B06B 1/04* (2006.01)
(Continued)

(52) U.S. Cl.
CPC ..... *H04R 9/066* (2013.01); *B06B 1/045* (2013.01); *G10K 9/12* (2013.01); *G10K 9/22* (2013.01); *H04R 2400/03* (2013.01)

(58) Field of Classification Search
CPC ..... H04R 9/06; H04R 9/043; H04R 9/025; H04R 2400/11; H04R 2499/13;
(Continued)

(56) References Cited

U.S. PATENT DOCUMENTS 4,641,345 A 2/1987 Takahashi
9,942,680 B1 * 4/2018 Little ..... H04R 1/06
(Continued)

FOREIGN PATENT DOCUMENTS

FI 20140019 A 7/2015
JP 2004336403 A 11/2004
(Continued)

*Primary Examiner* — Fan S Tsang
*Assistant Examiner* — Julie X Dang
(74) *Attorney, Agent, or Firm* — Berggren LLP

(57) ABSTRACT

The invention relates to a device for producing sound and vibration (10) for a user to hear and feel via surface contact, which comprises a damper mass plate (15) and an inertial actuator (16) attached thereto, which inertial actuator (16) comprises a damper mass (14), which is via a primary suspension (11) supported in a springing manner on the inertial actuator (16) to be moving substantially in one linear direction, which inertial actuator comprises a power source for the damper mass (14). The device (10) comprises a secondary suspension (12) and a mechanical limiter (13) for improving the performance of the inertial actuator and/or protecting it from external disturbances.

6 Claims, 3 Drawing Sheets

Figure 1A:
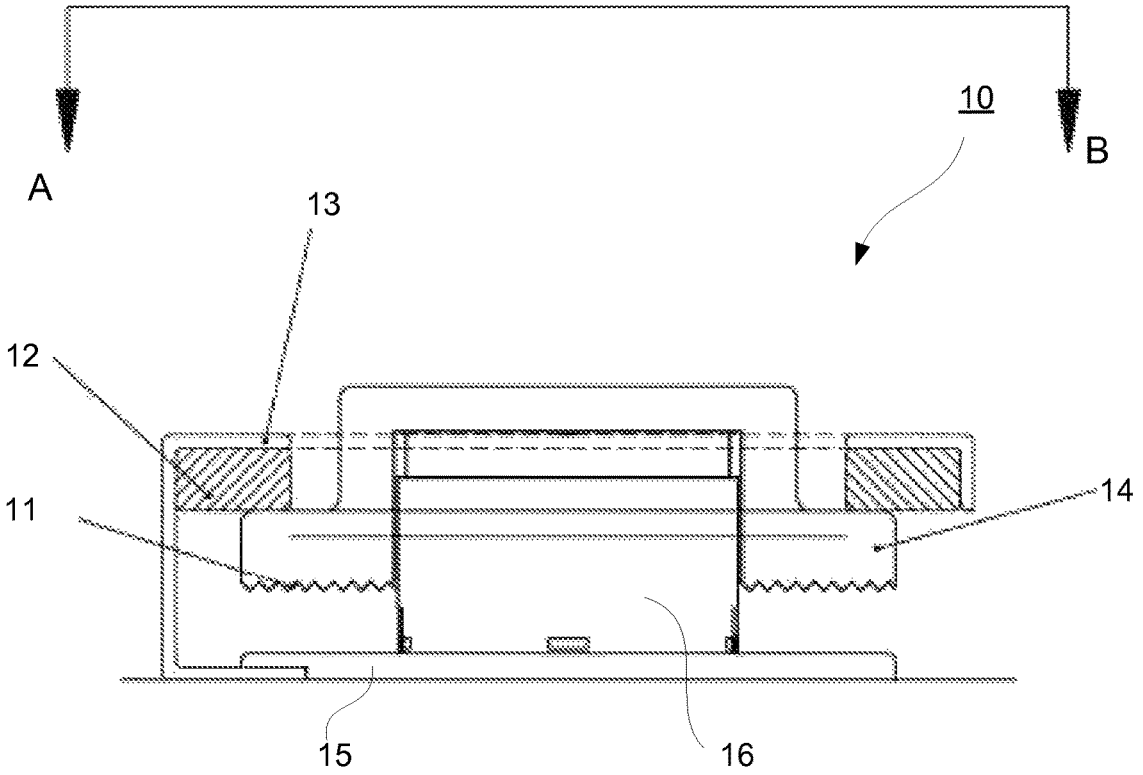

(51) Int. Cl.
*G10K 9/12* (2006.01)
*G10K 9/22* (2006.01)

(58) Field of Classification Search
CPC ..... H04R 7/18; H04R 9/02; H04R 31/006; H04R 7/12; H04R 1/025; H04R 7/04; B06B 1/0611; B06B 1/10; B06B 1/16
USPC ..... 381/396–404, 433
See application file for complete search history.

(56) References Cited

U.S. PATENT DOCUMENTS

| | | | | |
|---|---|---|---|---|
| 2007/0060207 | A1* | 3/2007 | Ueda | H04R 9/02 455/567 |
| 2010/0046788 | A1* | 2/2010 | Harris | H04R 9/043 381/404 |
| 2014/0029772 | A1* | 1/2014 | Kumagai | H04R 9/02 381/162 |

FOREIGN PATENT DOCUMENTS

| | | | | |
|---|---|---|---|---|
| JP | 2004351038 | A | * | 12/2004 |
| JP | 2004351038 | A | | 12/2004 |
| WO | 2010007335 | A1 | | 1/2010 |

* cited by examiner

APPARATUS FOR PRODUCING SOUND AND VIBRATION

PRIORITY

This application is a U.S. national application of the international application number PCT/FI2018/050261 filed on Apr. 11, 2018 and claiming priority of Finnish national application U20174102 filed on Apr. 13, 2017 the contents of all of which are incorporated herein by reference.

The invention relates to a device for producing sound and vibration for a user to hear and feel via surface contact. More particularly, the invention relates to a device for producing sound and vibration according to the preamble of claim 1.

As is known from prior art, perception of sound is based, in addition to hearing, also on the sense of touch. The sense of touch is primarily an involuntary sense, which functions in the background to give vital information about the state of a body (e.g. pain perception) and to control motoric function (surface sense tells when an object stays in one's hand). When listening, the attention is on the air sound transmitted via the ears. Sound however almost always also causes small mechanical vibrations near the listener, for example in a seat, in clothes and directly on the skin. This sound transmitted as feeling makes a listening experience closer and deeper. Vibration is felt especially with low sounds. Additionally, sounds slightly above the bass area frequencies are also perceivable. The skin's sense of touch is at its most sensitive typically in the 50-300 Hertz frequency range.

Finnish patent application no 20140019 shows a device for producing sound and vibration for a user to hear and feel via surface contact, where in order to obtain excellent sound reproduction and feel, one or more sound sources are placed inside a pillow or other padded object, wherein the pillow or other padded object is meant to touch the user in a conventional use situation. This known device for producing sound and vibration for a user to hear and feel via surface contact includes a mechanic actuator assembly arranged inside a wrapper, which actuator assembly consists of one or more stiff plates and one or more mechanical actuators for producing vibration in the mentioned one or more plates, thus causing a mechanical vibration directly in the wrapper, which both conducts vibration energy to the surface of the wrapper and produces an air sound through the wrapper, where the wrapper contains, in order to reduce acoustic and mechanical resonance, an inner acoustically more dense and lossy layer and an outer acoustically porous layer. The device's actuator advantageously contains at least one of the components: a perforated damper mass plate, a perforated outer shell for adjusting the frequency response and sound localization. In other words, the sound source or its parts touch the user indirectly, via a padding, whereby the first part of the sound produced by the sound source is air sound and the second part is sound perceivable via sense of touch, whereby it is possible to listen to music in different situations, and also enjoy the feeling brought on by an immersive experience. This prior art device thus realizes both an effect vibration and sound reproduction in the entire audio frequency range based on an inertial actuator, which has an elastic mechanical suspension for the moving damper mass.

As is known from prior art, in inertial actuators based on moving damper mass the suspension assembly, which makes possible a linear movement supported by one or more damping springs, may cause limitations at low frequencies, because the suspension is stiff and the deviation of the moving damper mass is limited. Additionally, an encased protective structure, especially in light structures, may cause problematic resonance frequencies in the structure at high frequencies. One factor, which causes problematic situations in inertial actuators based on moving damper mass, is the mechanical durability of the actuator for example in a transportation and/or falling situation, whereby the damper mass may detach from the suspension structure. Additionally, a damper mass meant to move in a linear manner in the normal direction can end up in a lateral or rotational motion, which causes disturbances in the sound and vibration and may lead to wear at some natural frequencies.

The object of the invention is to create a device for producing sound and vibration, where the disadvantages and problems of the arrangements known from prior art described above have been eliminated or at least minimized.

A particular object of the invention is to provide, with regards to its durability, a good device for producing sound and vibration, which can be used also at very low frequencies.

A particular object of the invention is also to provide a device for producing sound and vibration, where the structure protecting the device is utilized in the actual operation of the device.

A particular object of the invention is thus to create a device for producing sound and vibration, where the one-way movement of the damper mass of the inertial actuator is ensured and possible other movement directions than the movement in the desired direction are eliminated or at least minimized.

In order to obtain the objects presented above and later on, the device for producing sound and vibration according to the invention is mainly characterized in what is presented in the characterizing part of claim 1. Advantageous additional characteristics are defined in the dependent claims.

The device according to the invention for producing sound and vibration for a user to hear and feel via surface contact comprises a damper mass plate and an inertial actuator attached thereto, which inertial actuator comprises a damper mass, which is via a primary suspension supported in a springing manner on the inertial actuator to be moving substantially in one linear direction, which inertial actuator comprises a power source for the damper mass, which device comprises a secondary suspension and a mechanical limiter in order to improve the performance of the inertial actuator and/or protect it from external disturbances.

According to one advantageous additional characteristic of the invention the secondary suspension is a non-linear, elastic spring structure, which circles the inertial actuator's outer contours at a distance and is supported on the surface of the inertial actuator's damper mass, advantageously substantially on the outer contours of the damper mass.

According to one advantageous additional characteristic of the invention the mechanical limiter is placed to circle the inertial actuator externally at a distance from the inertial actuator's outer surface centrally or eccentrically, which mechanical limiter advantageously comprises several support shafts, which are placed on the outer contours at a distance from each other.

According to one advantageous additional characteristic of the invention the secondary suspension is attached to the mechanical limiter.

According to one advantageous additional characteristic of the invention the device further comprises a mechanically dampened resonator, which is arranged to protect the device's inertial actuator from hits and/or pressure load directed onto it, which mechanical dampened resonator is equipped with a divided reaction mass designed in an advantageous manner.

In this description and the following claims, the term protective structure generally means the parts protecting the device's inertial actuator from external harm, such as vibration, hits, pressure etc. arranged in the device: the mechanical limiter and/or secondary suspension and/or mechanically dampened resonator and its optional reaction mass, as is clear from the context.

The mechanical durability of the device according to the invention is good, because the mechanical limiter, to which the secondary suspension is integrated, prevents the damper mass from detaching, thus protecting the inertial actuator's structure for example in transport or falling situations.

The secondary suspension of the device according to the invention makes possible wider use of low frequencies when forming a more elastic suspension and a wider deviation range for the damper mass. Additionally, the secondary suspension dampens disturbances caused by possible lateral or rotational motion of the damper mass.

In the device according to the invention the primary suspension can be made to be elastic, which makes possible the operation of lower frequency ranges.

The elastic and light mechanical protection of the device according to the invention via a mechanical limiter makes possible the controlling and damping of resonance frequencies, which improves the frequency response in the overall performance and thus desired frequency ranges can for example be highlighted or dampened.

In an advantageous embodiment of the device according to the invention the device comprises a secondary suspension, which functions as an elastic support structure for the inertial actuator's structure and thus also softly limits the deviation of the damper mass during use and external hits and mechanically dampens possible lateral motion of the damper mass.

In an advantageous embodiment of the device according to the invention the structure of the inertial actuator is protected with a mechanically dampened resonator, which further improves the device's operation in problem situations and increases its performance and use possibilities over a wider frequency range.

In this advantageous embodiment of the invention the protective structure can be utilized for intensifying and regulating the actual operation of the device, for example in stagged tuning the impact range can be widened by using a mechanically dampened resonator formed of several parts as a protective structure. The protective structure can be a cup-like closed or perforated part, a frame-like structure. The protective structure can be rotationally symmetrical or eccentrical in relation to the inertial actuator.

The materials and material thicknesses of the different parts of the protective structure can vary and they are selected to achieve desired vibration parameters, for example experimentally, based on simulation, by programming and/or by calculation.

It must be noted that the device according to the invention is advantageously small in size and light-weight, so it can be used diversely in different applications for producing sound and vibration, especially in portable and/or mobile arrangements, such as for example in sound perception devices and perception pillow applications.

Figure 1B:
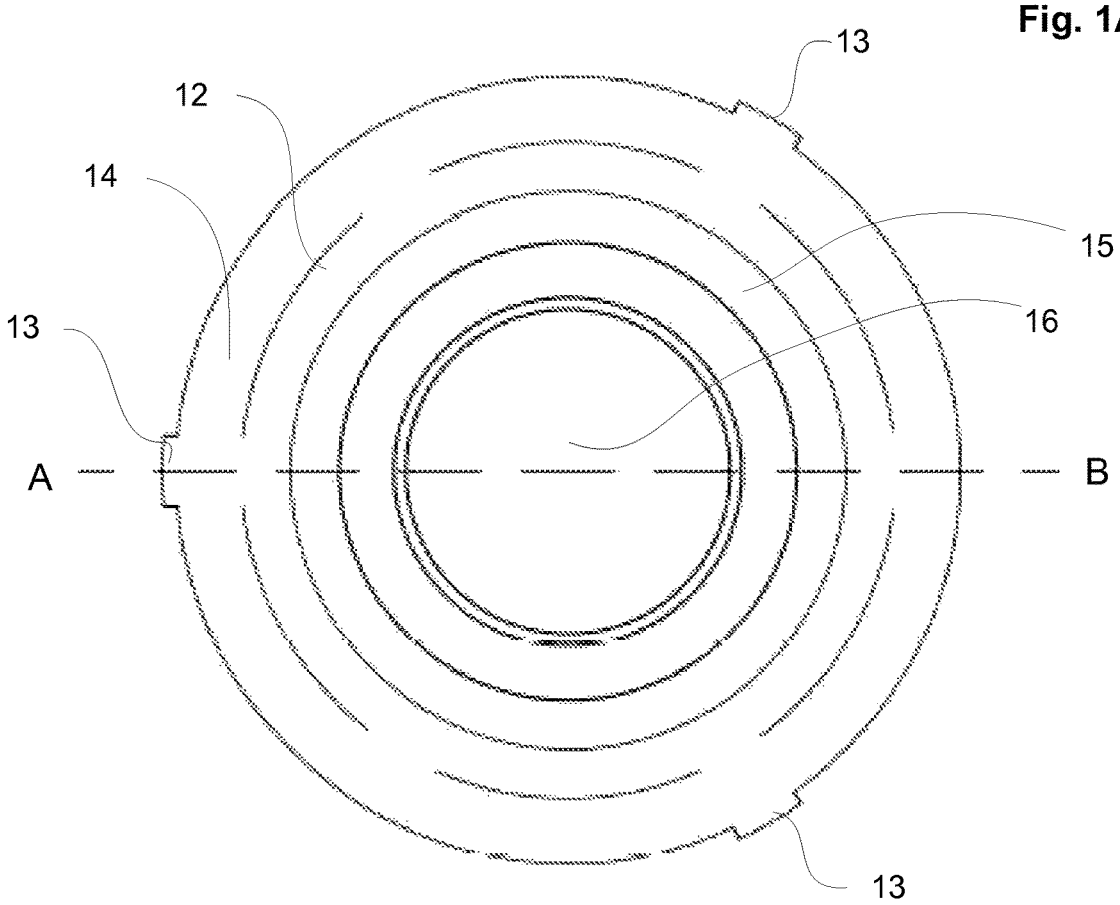
Figure 2A:
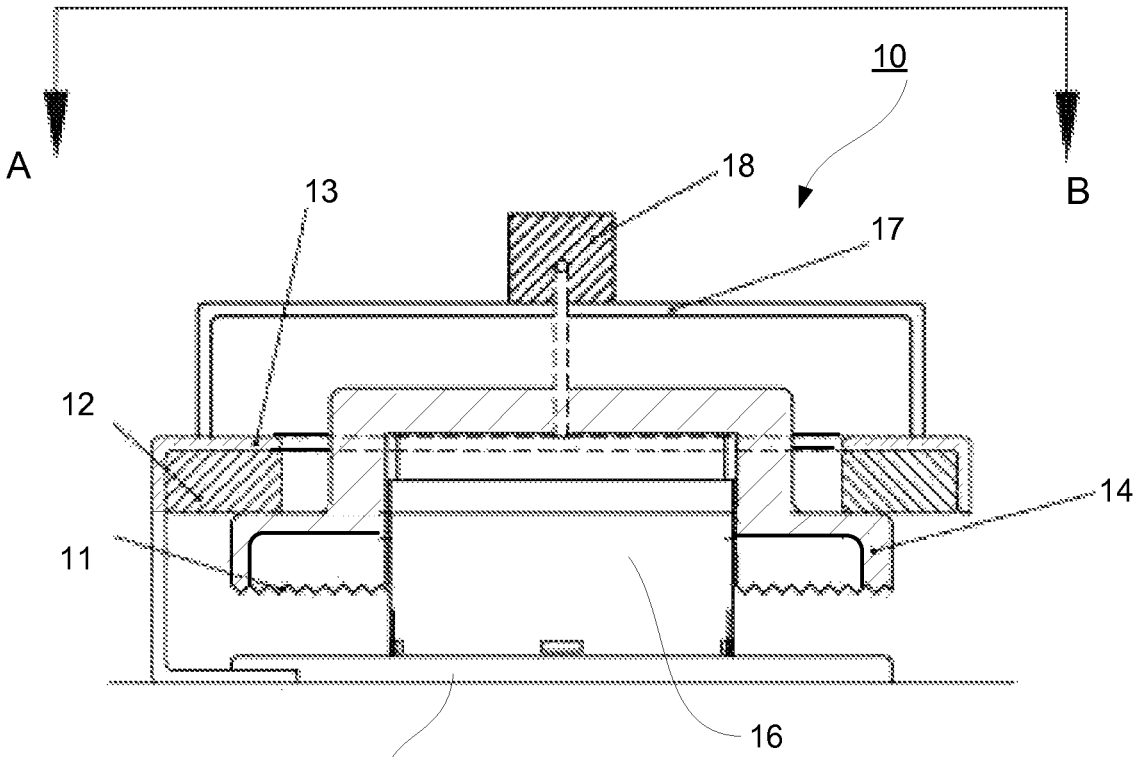
Figure 2B:
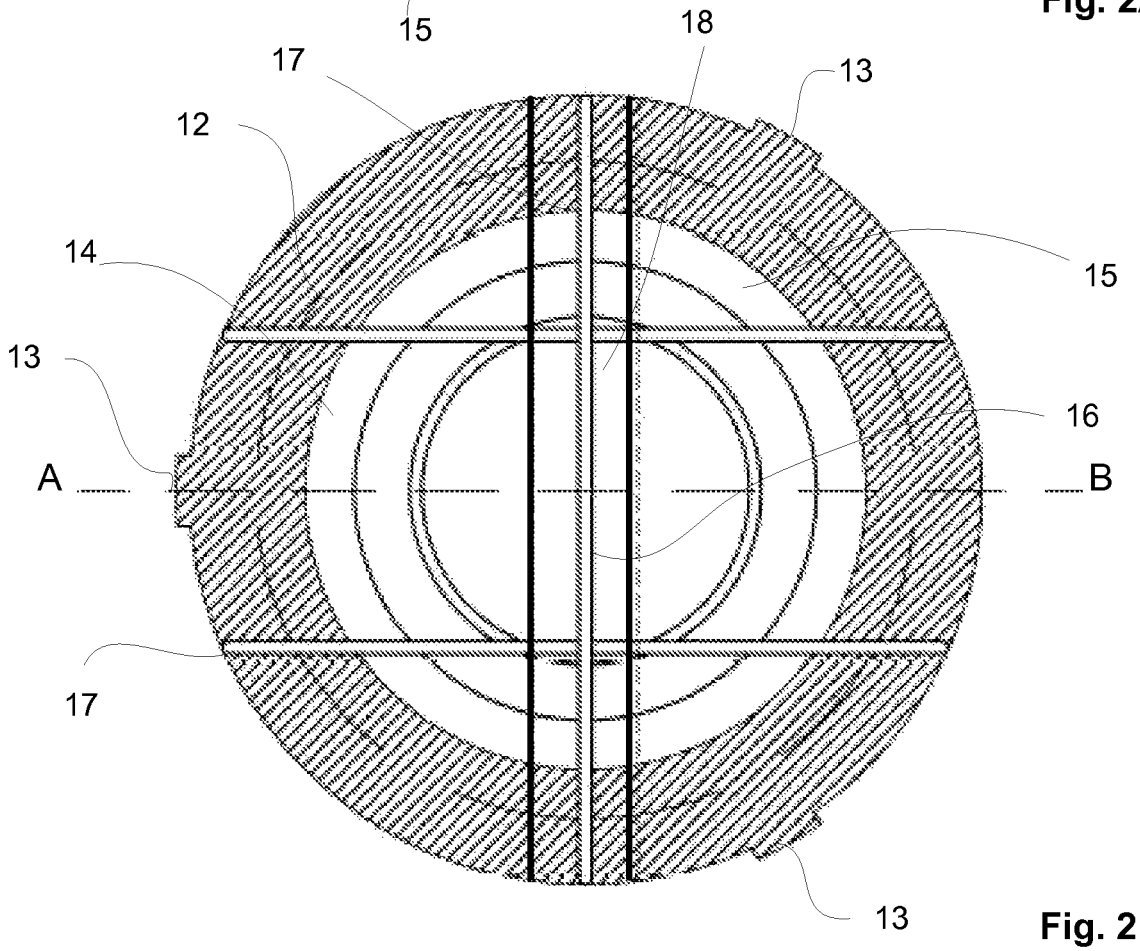
Figure 3:
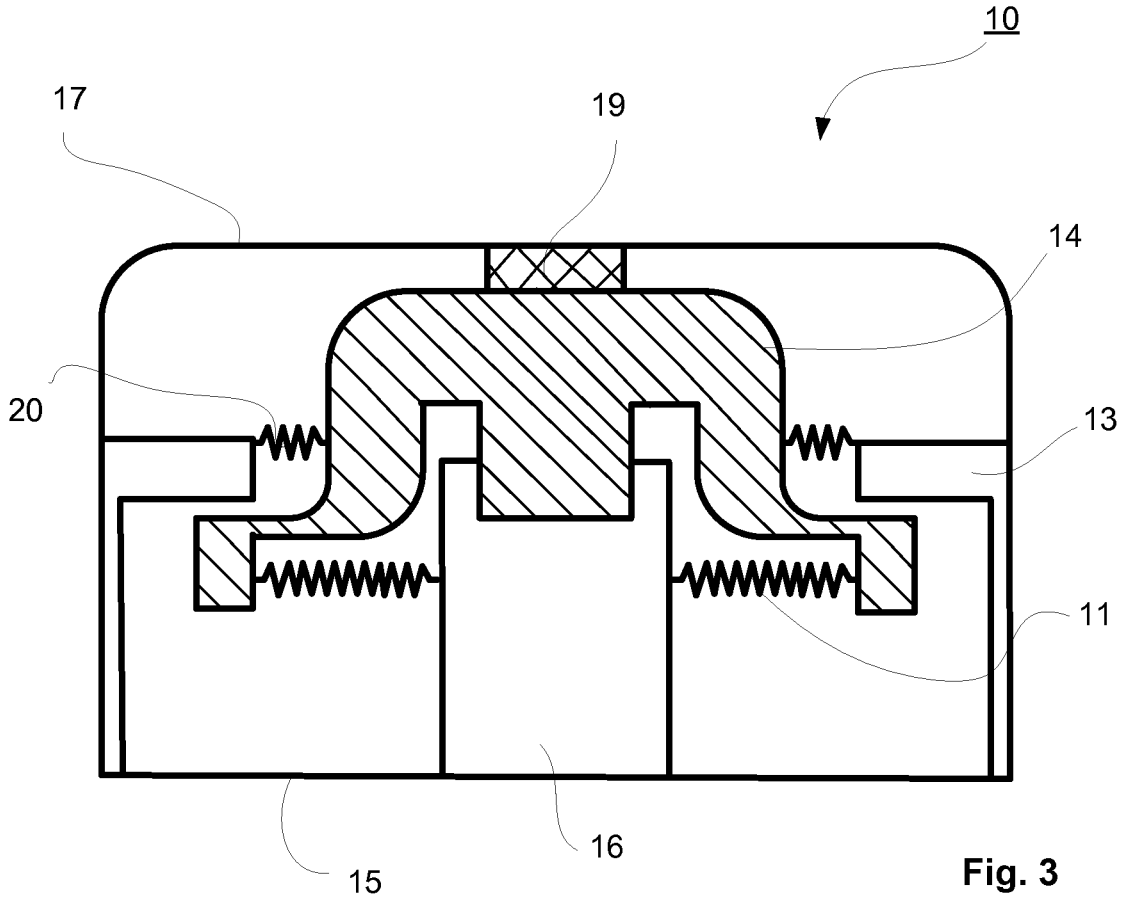

In the following, the invention is described in more detail with reference to the Figures of the appended drawing, where FIGS. 1A-1B show in a schematic manner one advantageous embodiment of a device according to the invention for producing sound and vibration, FIGS. 2A-2B show in a schematic manner a second advantageous embodiment of a device according to the invention for producing sound and vibration and FIG. 3 shows in a schematic manner a third advantageous embodiment of a device according to the invention for producing sound and vibration.

In the following description and corresponding figures, the same reference markings are used to refer to corresponding parts or part assemblies, if nothing else is mentioned. Some recurring reference markings may have been left out of the figures for the sake of clarity. In this description and the claims, terms expressing direction and/or location have been used when necessary, with reference to the examples shown in the figures and/or to facilitate understanding of the figures.

In the advantageous example shown in FIGS. 1A-1B the device 10 for producing sound and vibration comprises an inertial actuator 16 attached on a damper mass plate 15 i.e. stand 15, which inertial actuator creates the vibration transmitted to the plate 15 for producing sound and vibration. In order to produce sound, a frame of the inertial actuator has also been attached to the stand 15. The inertial actuator's damper mass 14 is via a primary suspension 11 supported in a springing manner to the inertial actuator's frame 16 to be moving substantially in the vertical direction.

The power source of the inertial actuator's damper mass 14 is a linearly moving actuator, which can be based on an electric magnet, smart material, piezo, hydraulics, pneumatics etc. The device 10 is advantageously a device as described in Finnish patent application 20140019 for producing sound and vibration. In order to protect the inertial actuator from external disturbances, such as vibration and hits, the device 10 comprises a secondary suspension 12 and a mechanical limiter 13. The secondary suspension 12, which thus to its basic structure advantageously is a non-linear spring structure, functions as a shock absorber and acoustic dampener by causing mechanical and acoustic losses. The mechanical limiter 13 is placed to circle the inertial actuator externally at a distance from the inertial actuator's outer surface centrally or eccentrically. The mechanical limiter 13 comprises two or more support shafts, which are placed on the outer contours at a distance from each other. The distance between two adjacent support shafts can always be the same length or different lengths. In the example shown in the figure the support shafts of the mechanical limiter 13 are placed around the periphery at 120° angular spacing. The outer contours of the mechanical limiter 13 in the direction can be a circle, an ellipsis, a polygon or another desired shape. The mechanical limiter 13 also comprises in the figure a horizontal support surface, on the bottom surface in the figure of which has been attached a secondary suspension 12, which is in the outer contour direction substantially continuous and is supported on the upper surface of the damper mass 14 in the figure. The secondary suspension 12 is an elastic damping part, which circles the outer contour and is supported on the surface of the damper mass 14 substantially over the entire periphery of the damper mass 14. Advantageously, the secondary suspension 12 is a rotationally symmetrical damping material with a thickness, which can comprise one or more damping material layers/sectors. The secondary suspension 12 can for example be a porous, foam-like or felt-like texture. The secondary suspension 12 advantageously dampens in a nonlinear, progressive manner, whereby it prevents sudden changes and achieves a to its form soft damping, and it also aids in controlling resonance frequencies, preventing e.g. resonance frequency spikes, and damping them. The secondary suspension 12 can be formed from one or several material layers, which are the same or different materials. The material of the secondary suspension 12 is advantageously felt, foam polymer, batt material. It can also be a cable damper or a hydraulic or pneumatic damper.

The advantageous example of a device according to the invention for producing sound and vibration shown in FIGS. 2A-2B to its basic structure corresponds to the example shown in FIGS. 1A-1B, further comprising a protective hood formed from a mechanically dampened resonator 17, for example to protect the device from hits and/or excessive loads directed toward it in the movement direction of the damper mass, from above in the figure. The mechanical dampened resonator 17 can also be equipped with a reaction mass 18, which is for example made of steel or another solid material, for intensifying the protection. The mechanical dampened resonator 17 is advantageously manufactured from a non-uniform structure, for example a perforated plate, stiff wire or a frame structure, which is for example made of a metallic material.

The advantageous example of a device according to the invention for producing sound and vibration shown in FIG. 3 to its basic structure corresponds to the example shown in FIGS. 1A-1B and 2A-2B, comprising an additional suspension 20 creating a springing support arranged between the damper mass 14 and the mechanical limiter 13. Additionally in this example, damping material 19 has additionally been placed between the mechanically dampened resonator 17 and damper mass 14, which damping material can comprise one or more damping material layers/sectors and can be for example a porous, foam-like or felt-like texture. The damping material 19 can be placed apart from the damper mass 14 or attached to it, and can function also as a mechanical limiter in addition to the limiter 13.

In accordance with the advantageous characteristics according to the advantageous examples shown in FIGS. 1A-1B, 2A-2B and 3, the device's 10 inertial actuator equipped with a damper mass 14 moving substantially in the vertical direction and forming a sound and vibration source is protected from external vibrations, hits etc. with a secondary suspension 12 and a mechanical limiter 13. The protective structure formed from the secondary suspension 12 and mechanical limiter 13 thus prevents malfunction caused by external impacts or its own resonances in the inertial actuator's movement and the vibration it creates. The mechanical limiter 13 is fitted to extend from the support shafts located on the periphery of the part providing the inertial force i.e. of the inertial actuator or as a part formed by the support shaft and it prevents an excessively large deviation of the damper mass and thus detachment of the damper mass from the structure. Advantageously the part of the device which forms the sound and vibration source is formed with a moving magnet principle to create an inertial force. The device's 10 inertial force can also be created in another manner known as such, for example using a mechanical, hydraulic or pneumatic actuator. Via the mechanical limiter 13 and the secondary suspension 12, a controlled elastic, progressive springing can be achieved for the movement of the damper mass 14. Advantageously the device 10 also comprises a protective structure formed from a mechanically dampened resonator 17, for example for protecting the device from hits and/or excessive loads directed toward it in the movement direction of the damper mass, from above in the figures. The mechanical dampened resonator 17 can also be equipped with a divided reaction mass 18 designed in an advantageous manner for improving vibration characteristics. The mechanical dampened resonator 17 is advantageously manufactured from a non-uniform structure, for example a perforated plate or a frame structure. Damping material can also be added to the mechanical dampened resonator 17, such as for example felt, foam-like polymer. The mechanical dampened resonator 17 can also be arranged to be operationally combined with the device's 10 external wrapper, such as the perception pillow material. The protective structures 12, 13, 17, 18 of the device 10 are advantageously manufactured from a material with a low specific gravity, so that the device 10 is altogether light and so that the weight of the protective structures does not disturb the operation of the damper mass plate 15.

The device 10 according to the invention is meant to function as a vibration source over a wide frequency band of 0-10 kHz. Thus, the device's 10 damper mass 14 is arranged to be supported on an especially elastic mechanical primary suspension 11, so that particularly low frequencies are attainable. Thus, the springing of the primary suspension 11 limits the movement of the damper mass 14 in a desired manner while the movement of the damper mass 14 creates vibration of the damper mass plate 15 in a desired frequency range. The primary suspension 11 can also be formed from several separate suspensions arranged side-by-side and/or in layers.

The invention has been described above only with reference to one advantageous example of it, to the details of which it is however not meant to narrowly limit the invention, but many other modifications and variations are possible within the inventive idea defined by the following claims.

The invention claimed is:

1. A device for producing sound and vibration for a user to hear and feel via a surface contact, the device comprising:

a damper mass plate and an inertial actuator attached thereto, the inertial actuator comprising a damper mass and a power source for the damper mass, the damper mass being supported via a primary suspension in a springing manner on the inertial actuator to be moving in one linear direction, wherein the device further comprises a secondary suspension and a mechanical limiter in order to improve the performance of the inertial actuator and/or protect it from external disturbances, and a mechanically dampened resonator arranged to protect the inertial actuator from hits and/or pressure load directed onto it, which mechanical dampened resonator is equipped with a divided reaction mass designed in an advantageous manner.

2. The device according to claim 1, wherein the secondary suspension is a non-linear, elastic spring structure, which circles the inertial actuator's outer contours at a distance and is supported on the surface of the inertial actuator's damper mass.

3. The device according to claim 1 wherein the mechanical limiter is placed to circle the inertial actuator externally at a distance from the inertial actuator's outer surface centrally or eccentrically.

4. The device according to claim 1, wherein the secondary suspension is attached to the mechanical limiter.

5. The device according to claim 2, wherein the secondary suspension is supported on outer contours of the damper mass.

6. The device according to claim 3, wherein the mechanical limiter comprises several support shafts placed on outer contours of the limiter at a distance from each other.

* * * * *